US008844439B2

(12) United States Patent
Ito et al.

(10) Patent No.: US 8,844,439 B2
(45) Date of Patent: Sep. 30, 2014

(54) LIQUID TRANSFER METHOD AND LIQUID TRANSFER APPARATUS

(75) Inventors: Reiji Ito, Ibaraki (JP); Akihiro Matsukawa, Ibaraki (JP); Yoshihito Nakamura, Ibaraki (JP)

(73) Assignee: Komori Corporation, Tokyo (JP)

( * ) Notice: Subject to any disclaimer, the term of this patent is extended or adjusted under 35 U.S.C. 154(b) by 565 days.

(21) Appl. No.: 12/079,571

(22) Filed: Mar. 26, 2008

(65) Prior Publication Data

US 2008/0236420 A1 Oct. 2, 2008

(30) Foreign Application Priority Data

Mar. 27, 2007 (JP) ..... 081309/2007

(51) Int. Cl.

| | |
|---|---|
| ***B41F 7/02*** | (2006.01) |
| ***B41F 5/02*** | (2006.01) |
| ***B41F 1/34*** | (2006.01) |
| ***B41F 21/12*** | (2006.01) |
| ***B41F 21/14*** | (2006.01) |
| ***B41L 1/02*** | (2006.01) |
| ***B41F 23/08*** | (2006.01) |

(52) U.S. Cl.

CPC ..... *B41F 23/08* (2013.01)
USPC ..... 101/217; 101/229; 101/485

(58) Field of Classification Search

CPC ..... B41F 23/08
USPC ..... 101/216, 217, 229, 231, 486; 118/46, 118/227, 249
See application file for complete search history.

(56) References Cited

U.S. PATENT DOCUMENTS

| | | | | |
|---|---|---|---|---|
| 2,677,971 | A * | 5/1954 | Greenwood | 74/395 |
| 5,350,623 | A * | 9/1994 | Derrick | 428/217 |
| 6,143,074 | A * | 11/2000 | Komori | 118/209 |
| 6,772,709 | B2 * | 8/2004 | Shibata | 118/46 |

FOREIGN PATENT DOCUMENTS

| | | |
|---|---|---|
| DE | 10 2004 016 673 | 10/2005 |
| EP | 0 564 856 | 10/1993 |
| EP | 0 873 867 | 10/1998 |
| JP | 2003-182031 A | 7/2003 |

* cited by examiner

*Primary Examiner* — Jill Culler
*Assistant Examiner* — Leo T Hinze
(74) *Attorney, Agent, or Firm* — Blakely Sokoloff Taylor & Zafman

(57) ABSTRACT

A liquid transfer method includes the steps of conveying a sheet by holding the sheet by a transport cylinder, and transferring a liquid to one surface of the sheet by a transfer cylinder opposing the transport cylinder and transferring the liquid to the other surface of the sheet by the transport cylinder. The step of transferring includes the step of positioning an edge of a region on one surface of the sheet, downstream in a sheet convey direction, where the liquid is to be transferred, upstream in the sheet convey direction of an edge of a region on the other surface of the sheet, downstream in the sheet convey direction, where the liquid is to be transferred. A liquid transfer apparatus is also disclosed.

7 Claims, 6 Drawing Sheets

LIQUID TRANSFER METHOD AND LIQUID TRANSFER APPARATUS

BACKGROUND OF THE INVENTION

The present invention relates to a liquid transfer method and liquid transfer apparatus which transfer a liquid such as varnish or ink to the two surfaces of a sheet.

As a conventional liquid transfer apparatus, one disclosed in Japanese Patent Laid-Open No. 2003-182031 is available. This liquid transfer apparatus comprises a first blanket cylinder (transport cylinder) which holds and conveys a sheet by gripping its one edge, and a second blanket cylinder which opposes the first blanket cylinder. As the sheet passes between the first and second blanket cylinders, varnish is transferred from the second blanket cylinder to the obverse of the sheet, thus coating the obverse of the sheet. Simultaneously, the printing pressure of the second blanket cylinder transfers the varnish from the first blanket cylinder to the reverse of the sheet, thus coating the reverse of the sheet as well.

In the conventional apparatus described above which transfers the liquid to the sheet, when performing overall coating on the two surfaces of the sheet, the following problem occurs. Note that overall coating refers to coating of the sheet entirely excluding margins reserved on the leading, trailing, left, and right edges of the sheet. When overall coating is to be performed on a sheet printed with ink, overall coating refers to coating that completely covers the images and register marks printed with the ink.

When performing overall coating on the two surfaces of the sheet, immediately after the leading edge of the sheet passes between the first and second blanket cylinders, the leading edge of the obverse of the sheet undesirably adheres to the second blanket cylinder due to the tackiness of the varnish on the obverse of the sheet, so that the leading edge of the reverse of the sheet is sometimes pulled to be separate from the surface of the first blanket cylinder. Then, transfer nonuniformities occur in the varnish transferred from the first blanket cylinder to the reverse of the sheet to degrade the coating quality. This problem also arises in a printing apparatus which prints using high-viscosity ink.

SUMMARY OF THE INVENTION

The present invention has been made to solve this problem and has as its object to prevent the sheet from separating from the transport cylinder, thus improving the transfer quality.

In order to achieve the above object, according to an aspect of the present invention, there is provided a liquid transfer method comprising the steps of conveying a sheet by holding the sheet by a transport cylinder and transferring a liquid to one surface of the sheet by a transfer cylinder opposing the transport cylinder, and transferring the liquid to the other surface of the sheet by the transport cylinder, wherein the step of transferring comprises the step of positioning an edge of a region on one surface of the sheet, downstream in a sheet convey direction, where the liquid is to be transferred, upstream in the sheet convey direction of an edge of a region on the other surface of the sheet, downstream in the sheet convey direction, where the liquid is to be transferred.

According to another aspect of the present invention, there is also provided a liquid transfer apparatus comprising a first transfer cylinder which transfers a liquid to one surface of a sheet, and a transport cylinder which opposes the first transfer cylinder, holds and conveys the sheet, and transfers the liquid to the other surface of the sheet, wherein the first transfer cylinder and the transport cylinder transfer the liquid such that an edge of a region on one surface of the sheet, downstream in a sheet convey direction, where the liquid is to be transferred is located upstream in the sheet convey direction of an edge of a region on the other surface of the sheet, downstream in the sheet convey direction, where the liquid is to be transferred.

DESCRIPTION OF THE PREFERRED EMBODIMENT

The embodiment of the present invention will be described with reference to the accompanying drawings. A case will be described with reference to FIGS. 1 to 9 in which a liquid transfer apparatus according to the present invention is applied to a coating unit in a printing press. This coating unit can subject one or two surfaces of a sheet to overall coating, or partial coating to coat only a specific portion. A case will be described in which the sheet is to be subjected to overall coating. The definition of overall coating is as described above.

Figure 1:
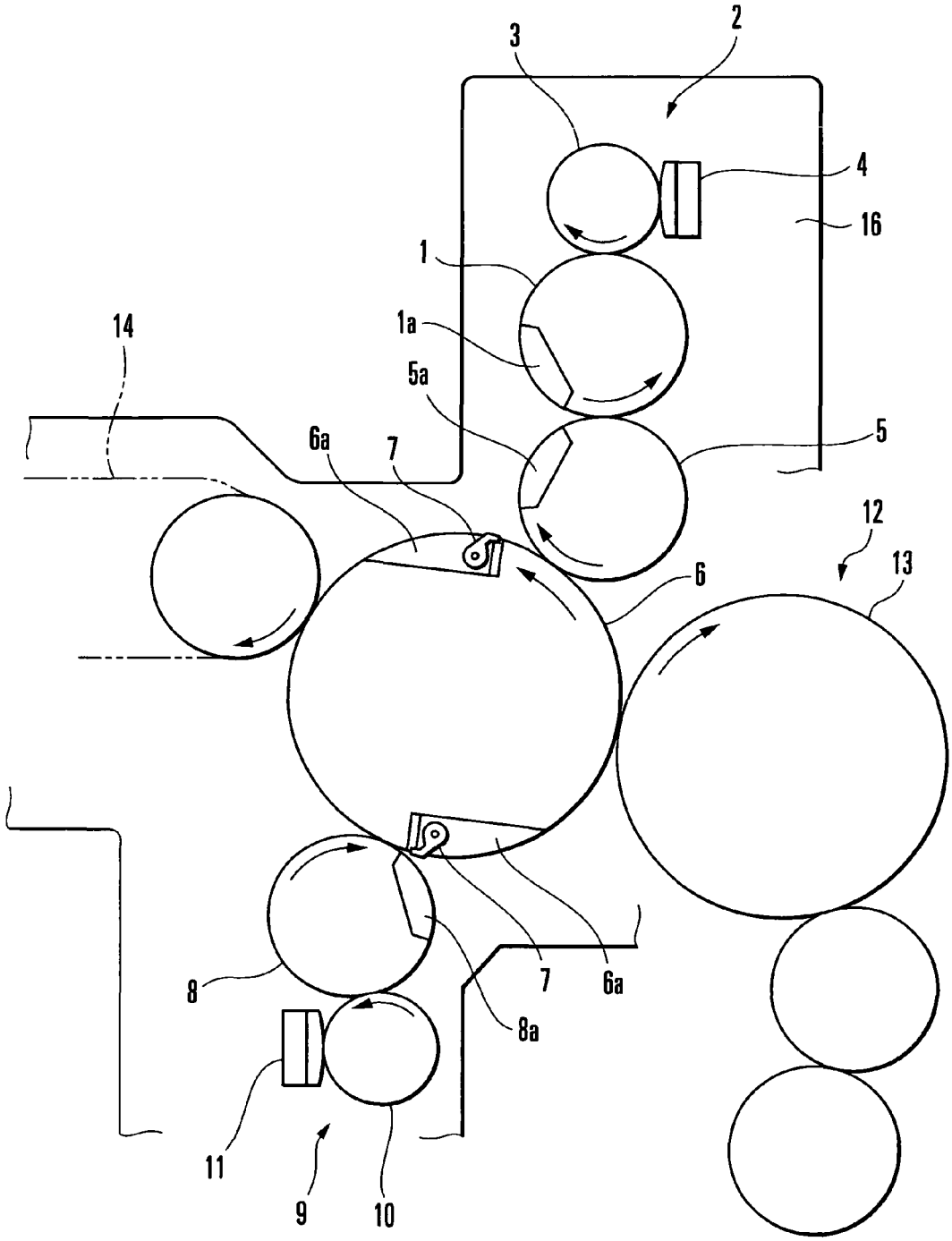
FIG. 1 is a side view of a coating unit in a printing press according to one embodiment of the present invention.

The coating unit will be briefly described with reference to FIG. 1. An upper plate cylinder 1 serves as a varnish supply cylinder (liquid supply cylinder) and is provided with a notch la, extending in the axial direction, in part of its circumferential surface. A first varnish supply device 2 is a first liquid supply means for supplying varnish to the upper plate cylinder 1, and comprises an upper anilox roller 3 in contact with the upper plate cylinder 1 and a chamber coater 4 which supplies the varnish to the upper anilox roller 3. The first varnish supply device 2 and upper plate cylinder 1 constitute a first varnish feeding device (first liquid feeding means) which supplies the varnish to the upper plate cylinder 1.

An upper blanket cylinder 5 is a printing cylinder serving as a first transfer cylinder, and is in contact with the upper plate cylinder 1 and opposes a blanket cylinder 6 (to be described later). The upper blanket cylinder 5 is provided with a notch 5*a*, extending in the axial direction, in part of its circumferential surface. The blanket cylinder 6 is a printing cylinder serving as a transport cylinder. The blanket cylinder 6 is provided with a pair of notches 6*a*, extending in the axial direction, at positions that halve the circumferential surface of the blanket cylinder 6 in the circumferential direction. A gripper unit 7 (sheet holding means) which grips and holds the sheet is arranged in each notch 6*a*.

A lower plate cylinder 8 serves as a second transfer cylinder in contact with the blanket cylinder 6, and is provided with a notch 8*a*, extending in the axial direction, in part of its circumferential surface. A second varnish supply device 9 is a second liquid supply means for supplying the varnish to the lower plate cylinder 8, and comprises a lower anilox roller 10 in contact with the lower plate cylinder 8, and a chamber coater 11 which supplies the varnish to the lower anilox roller 10. The second varnish supply device 9 and lower plate cylinder 8 constitute a second varnish feeding device (second varnish feeding means) which supplies the varnish to the lower plate cylinder 8.

The upper blanket cylinder 5 opposes the blanket cylinder 6, downstream of an opposing position where an impression cylinder 13 of a printing unit 12 provided upstream of the coating unit opposes the blanket cylinder 6, in the downstream rotational direction of the blanket cylinder 6. The lower plate cylinder 8 opposes the blanket cylinder 6, upstream of an opposing position where the impression cylinder 13 of the printing unit 12 opposes the blanket cylinder 6, in the upstream rotational direction of the blanket cylinder 6.

The varnish supplied from the chamber coater 4 to the upper anilox roller 3 is transferred to the upper blanket cylinder 5 through the upper plate cylinder 1, so that the obverse of printed paper (sheet), passing through the opposing point (nip) where the upper blanket cylinder 5 opposes the blanket cylinder 6, is coated. As the sheet passes the opposing position of the upper blanket cylinder 5 and blanket cylinder 6, the reverse of the printed sheet is coated with the varnish, transferred from the lower plate cylinder 8 to the circumferential surface of the blanket cylinder 6, by the printing pressure of the upper blanket cylinder 5. The sheet with the coated reverse is gripping-changed to the gripper of a delivery chain 14 and conveyed to a sheet delivery device (not shown).

A first phase adjustment device (first phase adjusting means) 15A provided to the upper plate cylinder 1 and a second phase adjustment device (second phase adjusting means) 15B provided to the lower plate cylinder 8 will be described with reference to FIGS. 2 and 3. As the first and second phase adjustment devices 15A and 15B have the same structure, only the first phase adjustment device 15A will be described, and the second phase adjustment device 15B will be described where necessary.

Figure 2:
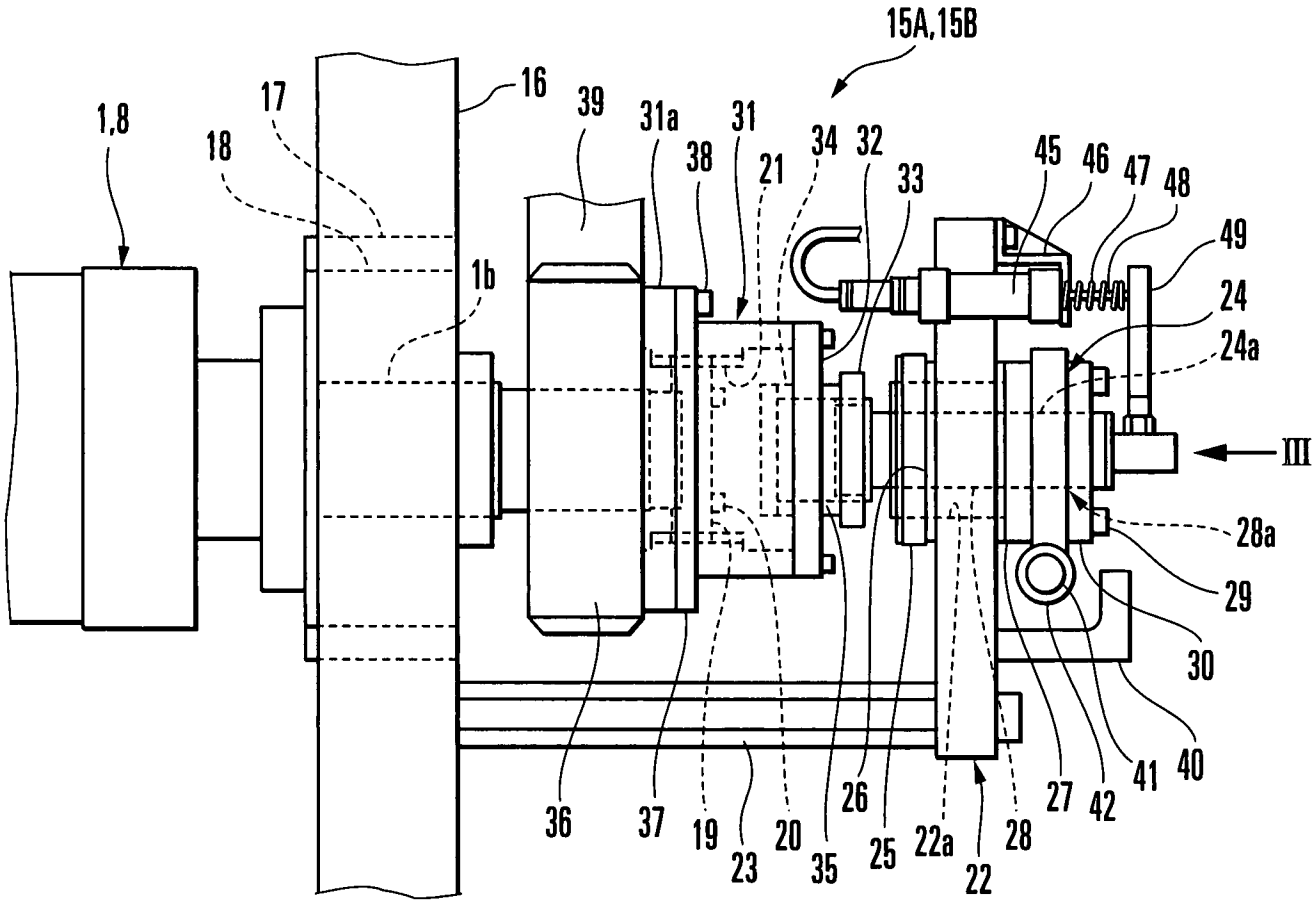
FIG. 2 is a side view of each of first and second phase adjustment devices.

Referring to FIG. 2, an end shaft 1*b* of the upper plate cylinder 1 is axially supported by an external metal member 17, axially supported by a frame 16 of the printing press, through an internal metal member 18. Bolts 20 fix an external gear 19 to the projecting end of the end shaft 1*b* projecting outside from the frame 16. The external gear 19 meshes with an internal gear 21 (to be described later).

Outside the frame 16, an almost triangular bracket 22 is attached to the frame 16 through a plurality of stays 23 to be parallel to the frame 16. A stepped worm wheel 24 is rotatably fitted in a bearing hole 22*a* of the bracket 22. A nut 25 threadably engaging with a threaded portion formed on the distal end of the worm wheel 24 presses a thrust bearing 26 (to be described later) against the bracket 22.

The thrust bearing 26 and a thrust bearing 27 are interposed on the two sides of the bracket 22 to sandwich it. A screw shaft 28 with a flange is inserted in a hole 24*a* formed in the inner peripheral portion of the worm wheel 24. A threaded plate 30 fixed to the worm wheel 24 with a bolt 29 threadably engages with the distal end of a threaded portion 28*a* of the screw shaft 28.

A coupling 31 has the internal gear 21 described above on its inner circumferential surface, and a disc 32 is threadably mounted on its one open end. One end of the screw shaft 28 described above is fitted in the inner hole of the disc 32. The flange of the screw shaft 28 and the nut 33 sandwich the disc 32. The flange of the screw shaft 28, the nut 33, and the disc 32 clamp thrust bearings 34 and 35. With this arrangement, the screw shaft 28 and coupling 31 are pivotal relative to each other while their movements in the axial directions are regulated.

A helical gear 36 is fixed to a flange 31*a* of the coupling 31 by a ring 37 and bolt 38, and meshes with a drive side helical gear 39. Rotation of the driving side is transmitted to the upper plate cylinder 1 through the helical gears 39 and 36, internal gear 21, and external gear 19. Since the external gear 19 and internal gear 21 slidably mesh with each other and the internal gear 21 has a large face width, even when the coupling 31 moves in the axial direction, the external gear 19 and internal gear 21 do not disengage from each other.

Figure 3:
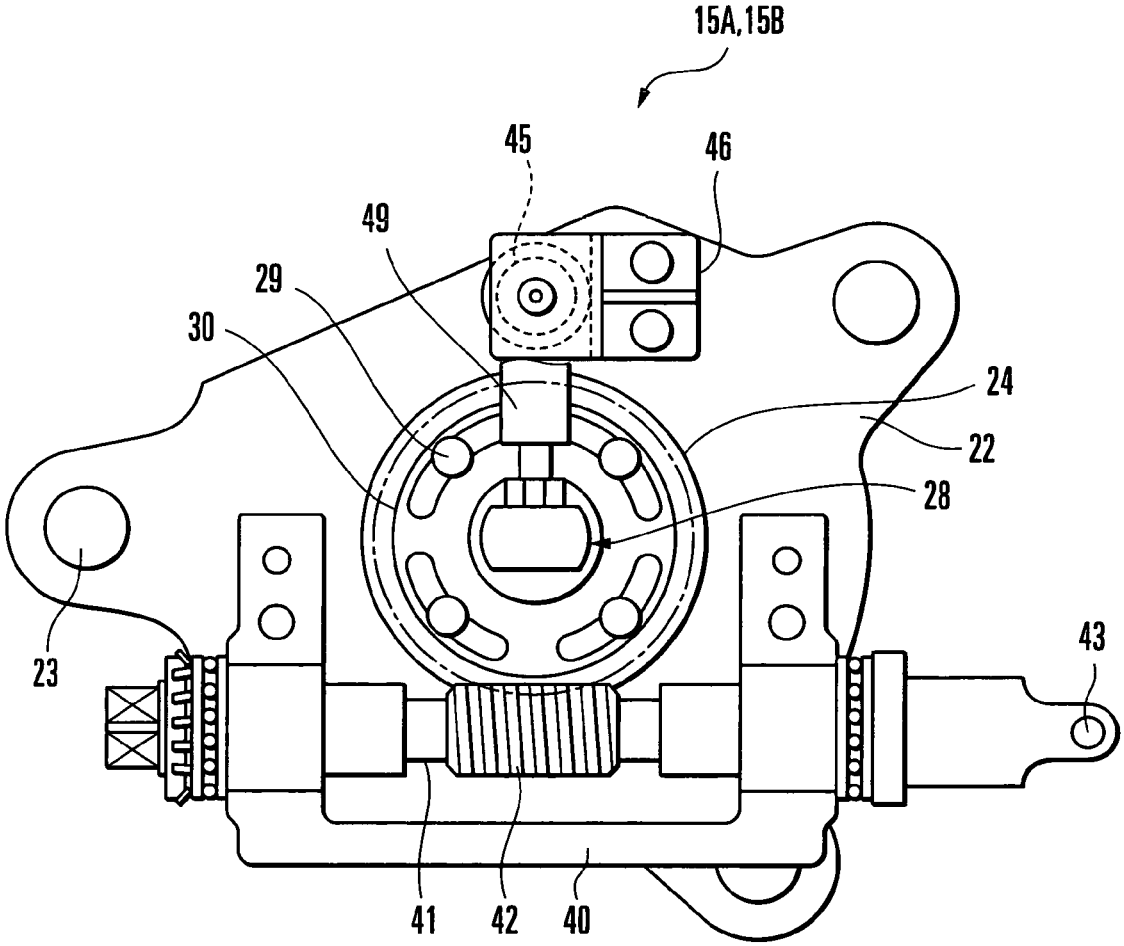
FIG. 3 is a view seen from the line of an arrow III in FIG. 2.

A bearing box 40 with a box-like shape as shown in FIG. 3 is fixed to the bracket 22 described above. A worm 42 meshing with the worm wheel 24 is axially mounted on a worm shaft 41 axially supported by the bearing box 40. The worm shaft 41 is connected to a motor (not shown) through a joint 43.

Another bracket 46 is fixed to the upper portion of the bracket 22. A linear displacement type potentiometer 45 is fixed to the bracket 46. The potentiometer 45 comprises a detection body 48 which is biased in the elongating direction by the spring force of a compression coil spring 47. A press body 49 is fixed to the distal end of the screw shaft 28. The upper end of the press body 49 is in contact with the detection body 48. As will be described later, when the screw shaft 28 moves in the axial direction upon phase adjustment of the upper plate cylinder 1, the press body 49 cooperates with the compression coil spring 47 to press the detection body 48. The potentiometer 45 detects the forward/backward moving amount of the detection body 48. The phase adjustment amount of the upper plate cylinder 1 is calculated from the forward/backward moving amount. A panel (not shown) displays the calculated phase adjustment amount.

Figure 4:
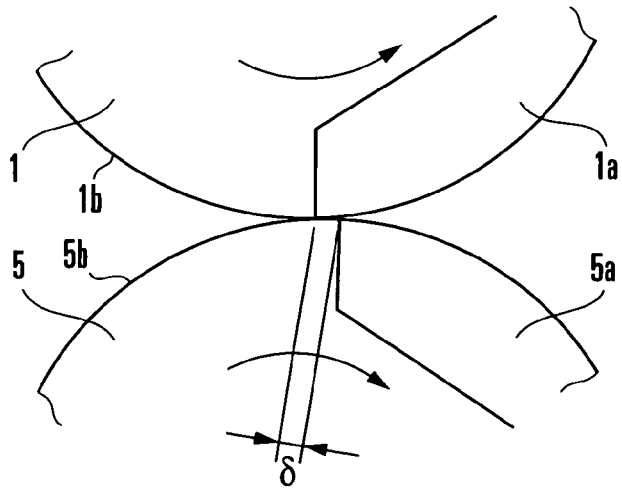
FIG. 4 is a side view of the main part to explain phase delay of an upper plate cylinder in the rotational direction with respect to an upper blanket cylinder.

In this arrangement, when the worm shaft 41 pivots to pivot the worm wheel 24, thus pivoting the screw shaft 28, the screw shaft 28 moves in the axial direction due to the screw function of the threaded portion 28*a*. The coupling 31 and helical gear 36 which are integral with the screw shaft 28 in the axial direction also move in the axial direction. The upper plate cylinder 1 slightly pivots in the circumferential direction due to the helical function of the helical gears 36 and 39, so that the phase of the upper plate cylinder 1 is adjusted with respect to the upper blanket cylinder 5. Thus, as shown in FIG. 4, the phase of the upper plate cylinder 1 is delayed from that of the upper blanket cylinder 5 by δ. More specifically, the rotation start of that effective impression area 1*b* of the upper plate cylinder 1, which is continuous to the notch 1*a*, is positioned upstream of a rotation start of an effective impression area 5*b* of the upper blanket cylinder 5, which is continuous to the notch 5*a*, by δ in the rotational direction of the upper plate cylinder 1. Similarly, when operating the second phase adjustment device 15B, the lower plate cylinder 8 slightly pivots in the circumferential direction to adjust its phase with respect to the blanket cylinder 6.

The mounting structures for blankets 63A and 63B which are mounted on the circumferential surface of the upper plate cylinder 1 and on that of the lower plate cylinder 8 will be described with reference to FIGS. 5 and 6. As the mounting structure for the upper plate cylinder 1 and that for the lower plate cylinder 8 are identical, only the mounting structure for the varnish supply cylinder blanket (blanket for a liquid supply cylinder) 63A and a varnish supply cylinder sheet member (sheet member for a liquid supply cylinder) 65A which are to be mounted on the upper plate cylinder 1 will be described, and the mounting structure for the second transfer cylinder blanket (blanket for a second transfer cylinder) 63B and a second transfer cylinder sheet member (sheet member for a second transfer cylinder) 65B which are to be mounted on the lower plate cylinder 8 will be described where necessary.

Figure 6:
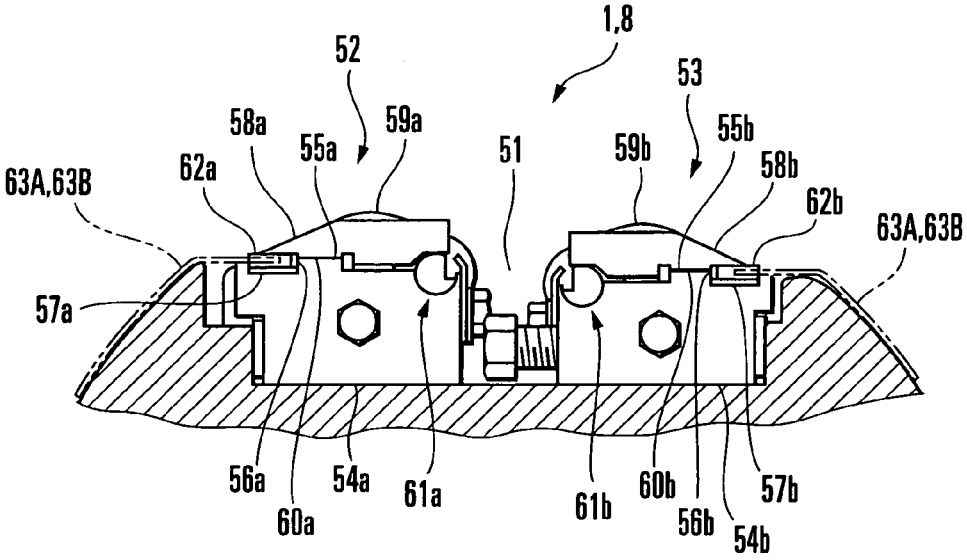
FIG. 6 is a sectional view taken along the line VI-VI of FIG. 5.

As shown in FIG. 6, the upper plate cylinder 1 is provided with a notch 51, extending throughout the entire length of the cylinder, in its circumferential surface. A leading edge plate clamp (plate member holding device) 52 and trailing edge plate clamp (plate member holding device) 53 extend in the notch 51 in the axial direction of the cylinder 1 to be parallel to each other. The leading edge plate clamp 52 and trailing edge plate clamp 53 are respectively provided with bottom clamping rails 54*a* and 54*b* extending in the axial direction of the cylinder 1. The bottom clamping rails 54*a* and 54*b* are respectively provided with gripping surfaces 55*a* and 55*b* and mouthpiece insertion grooves 56*a* and 56*b* on their upper surfaces. The mouthpiece insertion grooves 56*a* and 56*b* continue to the gripping surfaces 55*a* and 55*b*, respectively. The bottom surfaces of the mouthpiece insertion grooves 56*a* and 56*b* are parallel to the gripping surfaces 55*a* and 55*b*, respectively, and extend in the axial direction of the cylinder 1. Spacers 57*a* and 57*b* are fixed to the bottom surfaces of the mouthpiece insertion grooves 56*a* and 56, respectively.

Bolts 59*a* and 59*b* screwed into the upper portions of the bottom clamping rails 54*a* and 54*b* swingably support gripper boards 58*a* and 58*b*, respectively. The gripper boards 58*a* and 58*b* are respectively provided with gripping surfaces 60*a* and 60*b* which oppose the gripping surfaces 55*a* and 55*b* of the bottom clamping rails 54*a* and 54*b*, respectively. The distal ends of the gripping surfaces 60*a* and 60*b* cover the mouthpiece insertion grooves 56*a* and 56*b*, respectively. Round rod-like cams 61*a* and 61*b* are in contact with the rear ends of the gripper boards 58*a* and 58*b*, respectively. When the cams 61*a* and 61*b* are pivoted, the gripper boards 58*a* and 58*b* swing about the bolts 59*a* and 59*b* as swing centers, respectively.

A case in which the varnish supply cylinder blanket 63A is to be mounted on the upper plate cylinder 1 (or a case in which the second transfer cylinder blanket 63B is to be mounted on the lower plate cylinder 8) will be described. A mouthpiece 62*a* attached to one end of the varnish supply cylinder blanket 63A (or second transfer cylinder blanket 63B) is inserted in the mouthpiece insertion groove 56*a* of the bottom clamping rail 54*a*. The cam 61*a* is pivoted so that the distal end of the gripper board 58*a* covers the mouthpiece insertion groove 56*a*. Thus, the distal end of the gripper board 58*a* urges the mouthpiece 62*a* to fix it in the mouthpiece insertion groove 56*a*.

The varnish supply cylinder blanket 63A (or second transfer cylinder blanket 63B) is wound around the circumferential surface of the upper plate cylinder 1 (or lower plate cylinder 8), and a mouthpiece 62*b* attached to the other end of the varnish supply cylinder blanket 63A (or second transfer cylinder blanket 63B) is inserted in the mouthpiece insertion groove 56*b* of the bottom clamping rail 54*b*. The cam 61*b* is pivoted so that the distal end of the gripper board 58*b* covers the mouthpiece insertion groove 56*b*. Thus, the distal end of the gripper board 58*b* urges the mouthpiece 62*b* to fix it in the mouthpiece insertion groove 56*b*.

When the bottom clamping rail 54*b* slides toward the center of the notch 51, that is, in the direction to tighten the varnish supply cylinder blanket 63A (or second transfer cylinder blanket 63B) to be close to the bottom clamping rail 54*a*, the varnish supply cylinder blanket 63A (or second transfer cylinder blanket 63B) is tightened to come into tight contact with the circumferential surface of the cylinder 1.

Figure 5:
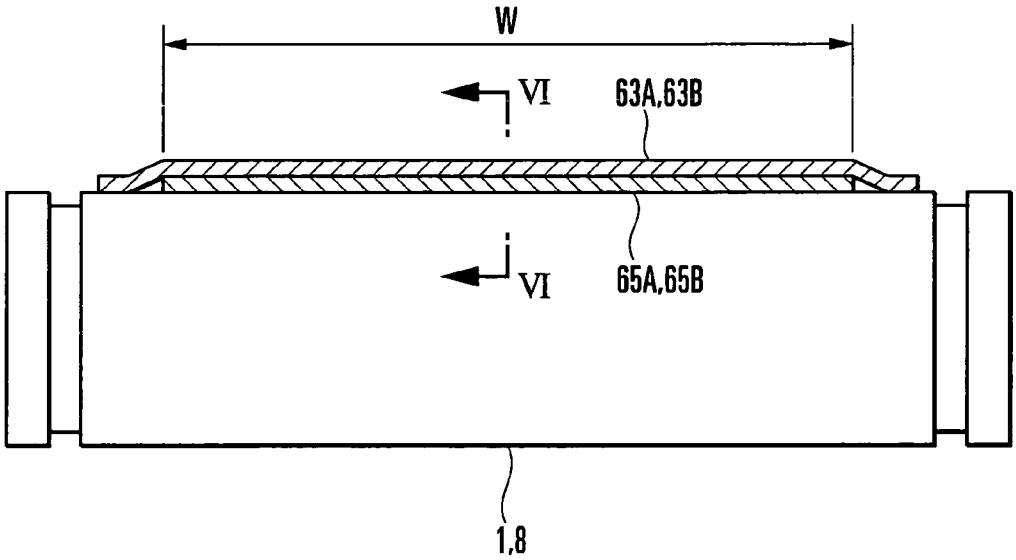
FIG. 5 is a front view showing a mounted state of blankets which are to be mounted on the circumferential surface of the upper plate cylinder and that of a lower plate cylinder.

Referring to FIG. 5, the varnish supply cylinder sheet member 65A is interposed between the varnish supply cylinder blanket 63A and the circumferential surface of the upper plate cylinder 1, and is a so-called blanket underlying member. The varnish with the same shape as the outer shape of the varnish supply cylinder sheet member 65A is transferred to the obverse of the sheet, being conveyed by the blanket cylinder 6, through the upper blanket cylinder 5. More specifically, the varnish with the same width as a length W of the varnish supply cylinder sheet member 65A in the widthwise direction is transferred to the obverse of the sheet, and the varnish with the same length as the circumferential length of the varnish supply cylinder sheet member 65A is transferred to the obverse of the sheet.

The second transfer cylinder sheet member 65B is interposed between the second transfer cylinder blanket 63B and the circumferential surface of the lower plate cylinder 8, and is a so-called blanket underlying member. The varnish with the same shape as the outer shape of the second transfer cylinder sheet member 65B is transferred to the reverse of the sheet, being conveyed by the blanket cylinder 6, through the blanket cylinder 6. More specifically, the varnish with the same width as a length W of the second transfer cylinder sheet member 65B in the widthwise direction is transferred to the reverse of the sheet, and the varnish with the same length as the circumferential length of the second transfer cylinder sheet member 65B is transferred to the reverse of the sheet.

Figure 7:
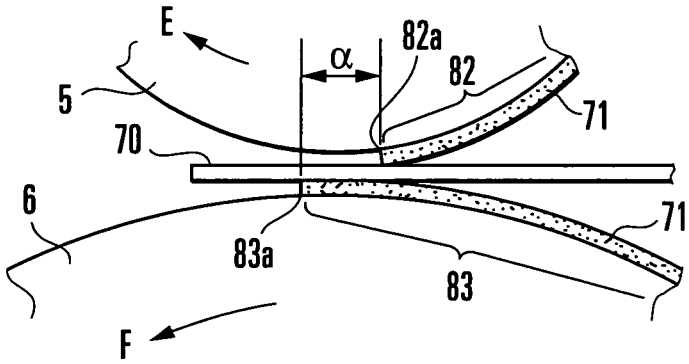
FIG. 7 is an enlarged side view of an opposing portion of the upper blanket cylinder and a blanket cylinder when coating the obverse and reverse of a sheet.

According to this embodiment, as shown in FIG. 4, the first phase adjustment device 15A adjusts the phase of the upper plate cylinder 1 to be delayed from the phase of the upper blanket cylinder 5 by $\delta$, and the second phase adjustment device 15B adjusts the phase of the lower plate cylinder 8. After the cylinder phases are adjusted in this manner, the first and second varnish feeding devices described above supply the varnish to the upper blanket cylinder 5 and blanket cylinder 6, respectively. Thus, as shown in FIG. 7, an edge 82*a* of that region 82 of the upper blanket cylinder 5, downstream in the rotational direction (on the side in a direction E), where varnish 71 is supplied to the upper blanket cylinder 5 is positioned more upstream, by a length $\alpha$ in the upstream rotational direction of the upper blanket cylinder 5, of an edge 83*a* of a region 83 of the blanket cylinder 6, downstream in the rotational direction (on the side in a direction F), where the varnish 71 is supplied to the blanket cylinder 6.

Figure 8:
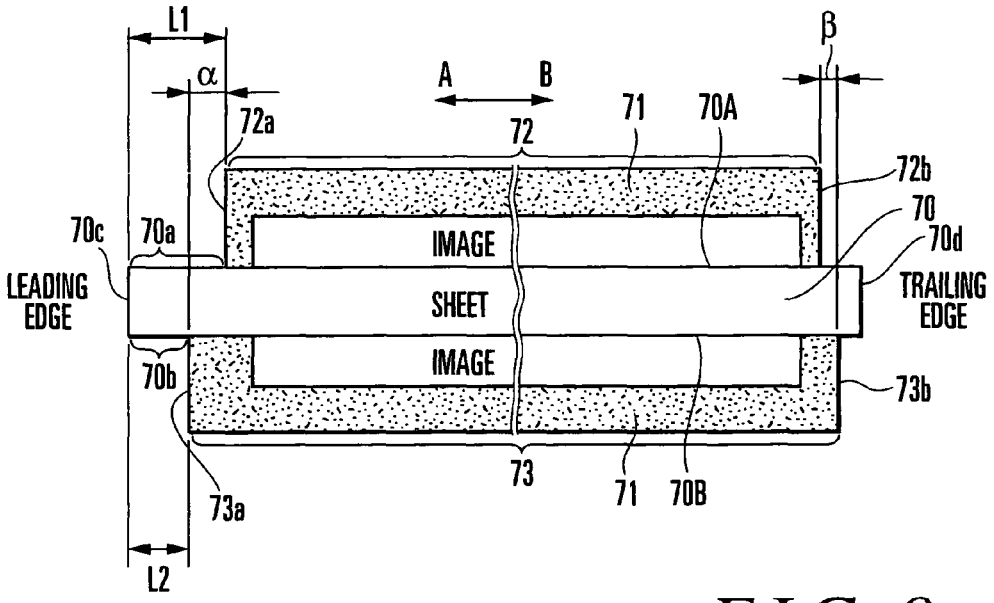
FIG. 8 is a schematic side view showing a state in which the obverse and reverse of the sheet are coated.

In the sheet 70 that has passed between the upper blanket cylinder 5 and blanket cylinder 6, as shown in FIG. 8, a leading (downstream in the sheet convey direction or in the direction of an arrow A) margin 70*a* of an obverse 70A of the sheet 70 which is not coated with the varnish 71 becomes larger by a length $\alpha$ than a leading margin 70*b* of a reverse 70B of the sheet 70 which is not coated with the varnish 71. In other words, a leading edge 72*a* of a coating region 72 of the obverse 70A of the sheet 70 is positioned on the trailing side (upstream in the sheet convey direction or in the direction of an arrow B) of a leading edge 73*a* of a coating region 73 of the reverse 70B of the sheet 70 by the length $\alpha$.

The adjustment ranges of the first and second phase adjustment devices 15A and 15B are set such that a minimum value L1min of the length of the leading margin 70*a* of the obverse 70A of the sheet 70 which is adjusted by the first phase adjustment device 15A becomes lager than a maximum value L2max of the length of the leading margin 70*b* of the reverse 70B of the sheet 70 which is adjusted by the second phase adjustment device 15B. Thus, no matter how the first and second phase adjustment devices 15A and 15B may be adjusted, the length of the leading margin 70*a* of the obverse 70A of the sheet 70 does not become smaller than the length of the leading margin 70*b* of the reverse 70B. Therefore, the conventional problem does not occur, as will be described later.

The lengths of the leading margins 70*a* and 70*b* refer to the lengths from a leading edge 70*c* of the sheet 70 to leading edges 72*a* and 73*a* of the coating regions (liquid transfer regions) 72 and 73, respectively, in the sheet convey direction. The lengths of the trailing margins refer to the lengths from a trailing edge 70*d* of the sheet 70 to trailing edges 72*b* and 73*b* of the coating regions (liquid transfer regions) 72 and 73, respectively, in the sheet convey direction. The left and right margin lengths refer to the lengths from left and right trailing edges 70*e* and 70*f* of the sheet 70 to left and right trailing edges 72*c* and 72*d* and left and right trailing edges 73*c* and 73*d* of the coating regions (liquid transfer regions) 72 and 73, respectively, in the direction of sheet width.

According to this embodiment, the length of the varnish supply cylinder sheet member 65A in the circumferential direction (the directions of the arrows A and B) is smaller than the length of the second transfer cylinder sheet member 65B in the circumferential direction (the directions of the arrows A and B), so that the trailing edge 72*b* of the coating region 72 of the obverse 70A of the sheet 70 is located closer to the leading side by a length β than the trailing edge 73*b* of the coating region 73 of the reverse 70B of the sheet 70. The circumferential direction of the varnish supply cylinder sheet member 65A refers to the direction that corresponds to the circumferential direction of the upper plate cylinder 1 when the varnish supply cylinder sheet member 65A is mounted on the upper plate cylinder 1. Similarly, the circumferential direction of the second transfer cylinder sheet member 65B refers to the direction that corresponds to the circumferential direction of the lower plate cylinder 8 when the second transfer cylinder sheet member 65B is mounted on the lower plate cylinder 8.

Figure 9:
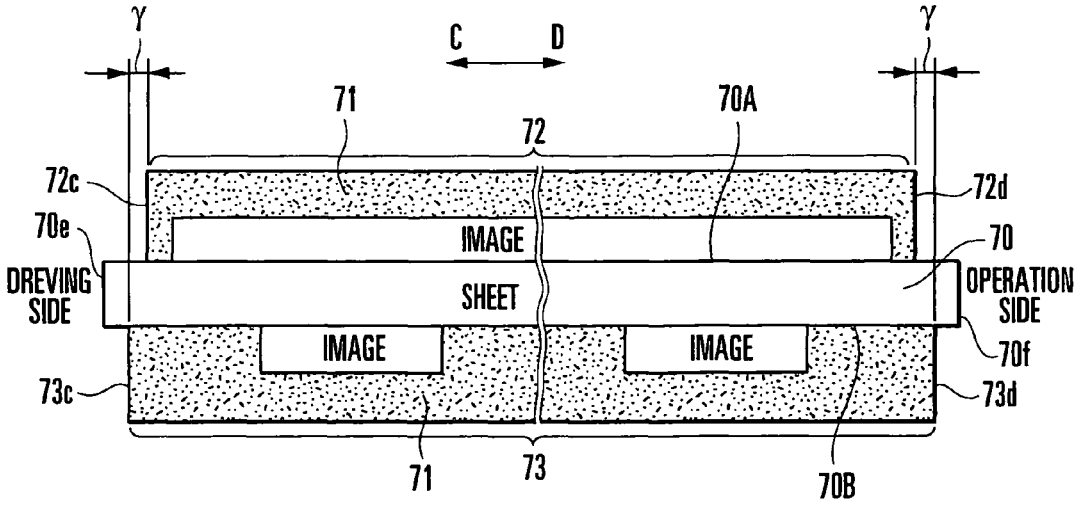
FIG. 9 is a schematic front view showing a state in which the obverse and reverse of the sheet are coated.

According to the present invention, as shown in FIG. 9, the length of the varnish supply cylinder sheet member 65A in the widthwise direction (the direction perpendicular to the circumferential direction) is smaller than that of the second transfer cylinder sheet member 65B in the widthwise direction (the direction perpendicular to the circumferential direction) such that the left and right (in the widthwise direction or directions of arrows C and D) edges 72*c* and 72*d* of the coating region 72 of the obverse 70A of the sheet 70 are located within the sheet 70 to be inside the left and right (in the widthwise direction or the directions of arrows C and D) trailing edges 73*c* and 73*d* of the coating region 73 of the reverse 70B of the sheet 70 each by a length γ than. The widthwise direction of the varnish supply cylinder sheet member 65A refers to the direction that corresponds to the axial direction of the upper plate cylinder 1 when the varnish supply cylinder sheet member 65A is mounted on the upper plate cylinder 1. Similarly, the widthwise direction of the second transfer cylinder sheet member 65B refers to the direction that corresponds to the axial direction of the lower plate cylinder 8 when the second transfer cylinder sheet member 65B is mounted on the lower plate cylinder 8.

Immediately after the sheet 70 passes through the nip between the upper blanket cylinder 5 and blanket cylinder 6, the tackiness of the varnish on the obverse 70A of the sheet 70 exerts a force to stick the sheet 70 to the upper blanket cylinder 5. According to this embodiment, however, as shown in FIG. 8, when the leading edge 70*c* of the sheet 70 passes between the blanket cylinder 6 and upper blanket cylinder 5, the varnish is applied to the reverse 70B of the sheet 70, prior to the obverse 70A of the sheet 70, starting from the portion closer to the leading edge 70*c*. As coating of the reverse 70B is started prior to the obverse 70A of the sheet 70 in this manner, the tackiness of the varnish on the reverse 70B of the sheet 70 serves to prevent the leading edge of the sheet 70 from separating from the blanket cylinder 6 to undesirably stick to the circumferential surface of the upper blanket cylinder 5. As a result, the blanket cylinder 6 suppresses varnish nonuniformities in the coating region 73 of the reverse 70B of the sheet 70, thus improving the coating quality.

On the trailing edge side of the sheet 70, the varnish is applied to the reverse 70B of the sheet 70 even after it is applied to the obverse 70A of the sheet 70. Thus, after the trailing edge 70*d* of the sheet 70 passes between the blanket cylinder 6 and upper blanket cylinder 5, the trailing edge of the obverse 70A of the sheet 70 does not stick to the circumferential surface of the upper blanket cylinder 5. Hence, the blanket cylinder 6 suppresses varnish nonuniformities in the coating region 73 of the reverse 70B of the sheet 70, thus improving the coating quality.

As the sheet 70 passes between the blanket cylinder 6 and upper blanket cylinder 5, the sheet 70 is coated such that the left and right edges 72*c* and 72*d* of the coating region 72 of the obverse 70A of the sheet 70 is located within the sheet 70 to be inside the left and right edges 73*c* and 73*d* of the coating region 73 of the reverse 70B of the sheet 70 by the length γ. As the coating region 73 of the reverse 70B of the sheet 70 is larger than the coating region 72 of the obverse 70A of the sheet 70 in this manner, after the sheet 70 passes between the blanket cylinder 6 and upper blanket cylinder 5, the left and right edges of the obverse 70A of the sheet 70 do not stick to the circumferential surface of the upper blanket cylinder 5. Thus, the blanket cylinder 6 suppresses varnish nonuniformities in the coating region 73 of the reverse 70B of the sheet 70, thus improving the coating quality.

According to this embodiment, varnish (coating liquid) is employed as the liquid to be transferred. The present invention can also be applied to ink with a comparatively high viscosity. Although the sheet to which the liquid is to be transferred is exemplified by paper sheet, the transfer target can be any other sheet. For example, a non-rigid sheet such as a synthetic resin film or vinyl film can be employed as the transfer target sheet.

In this embodiment, a phase signifies a position on the cylinder in the rotational direction and is expressed by an angle with respect to the reference position of the cylinder.

What is claimed is:

1. A liquid transfer method for use with a liquid transfer apparatus which applies overall coating which transfers liquid on an entire surface of one side or both sides of a sheet and partial coating which transfers liquid on a specific portion of one side or both sides of the sheet, the method comprising the steps of:

positioning a first notch of a liquid supply cylinder and a starting end of an first effective impression area which is continuous to the first notch respectively upstream of a second notch of a transfer cylinder that is in contact with said liquid supply cylinder and a starting end of a second effective impression area which is continuous to the second notch in a rotational direction of said liquid supply cylinder by rotating said liquid supply cylinder;

conveying the sheet by holding the sheet by a transport cylinder;

supplying said liquid from said liquid supply cylinder to said transfer cylinder while maintaining a phase relationship between said liquid supply cylinder and said transfer cylinder in the positioning step; and transferring the liquid to the entire surface of one side of the sheet by the transfer cylinder and transferring the liquid to the entire surface of the other side of the sheet by the transport cylinder, wherein the step of transferring comprises a step of positioning an edge, on a downstream side in a sheet convey direction, of the entire surface of one side of the sheet where the liquid is to be transferred, upstream of an edge, on a downstream side in the sheet convey direction, of the entire surface of the other side of the sheet where the liquid is to be transferred.

2. A method according to claim 1, wherein the step of transferring comprises the step of positioning an edge of the one side of the sheet, upstream in the sheet convey direction. where the liquid is to be transferred, to be downstream in the sheet convey direction of an edge of the other side of the sheet, upstream in the sheet convey direction, where the liquid is to be transferred.

3. A method according to claim 1, wherein the step of transferring further comprises the step of positioning an edge of the one side of the sheet, in a direction perpendicular to the sheet convey direction, where the liquid is to be transferred, to be inside an edge of the other side of the sheet, in the direction perpendicular to the sheet convey direction, where the liquid is to be transferred.

4. A method according to claim 1, further comprising the step of supplying the liquid to each of the transfer cylinder and the transport cylinder such that an edge of a region of the transfer cylinder, downstream in a rotational direction, where the liquid is to be transferred to the transfer cylinder is located upstream in the rotational direction of the transfer cylinder, of an edge of a region of the transport cylinder, downstream in the rotational direction, where the liquid is to be transferred to the transport cylinder.

5. A method according to claim 1, wherein said overall coating is coating which completely coats a pattern printed on said sheet with ink.

6. A liquid transfer apparatus which applies overall coating which transfers liquid on an entire surface of one side or both sides of a sheet and partial coating which transfers liquid on a specific portion of one side or both sides of the sheet, the apparatus comprising:

a first transfer cylinder which transfers the liquid to the entire surface of one side of the sheet; and a transport cylinder which opposes said first transfer cylinder, holds and conveys the sheet, and transfers the liquid to the entire surface of the other side of the sheet, wherein said first transfer cylinder and said transport cylinder transfer the liquid such that an edge, on a downstream side in a sheet convey direction, of the entire surface of one side of the sheet where the liquid is to be transferred, is located upstream of an edge, on a downstream side in the sheet convey direction, of the entire surface of the other side of the sheet where the liquid is to be transferred, the apparatus further comprising:

a liquid supply cylinder which comes into contact with said first transfer cylinder to supply the liquid thereto, a second transfer cylinder which comes into contact with said transport cylinder to transfer the liquid thereto, wherein said liquid supply cylinder comprises a blanket for said liquid supply cylinder to be mounted on a circumferential surface of said liquid supply cylinder, and a sheet member for said liquid supply cylinder to be sandwiched between said blanket for said liquid supply cylinder and said circumferential surface of said liquid supply cylinder, said second transfer cylinder comprises a blanket for said second transfer cylinder to be mounted on a circumferential surface of said second transfer cylinder and a sheet member for said second transfer cylinder to be sandwiched between said blanket for said second transfer cylinder and said circumferential surface of said second transfer cylinder, and a length of said sheet member for said liquid supply cylinder in a circumferential direction of said liquid supply cylinder is smaller than that of said sheet member for said second transfer cylinder in a circumferential direction of said second transfer cylinder.

7. A liquid transfer apparatus which applies overall coating which transfers liquid on an entire surface of one side or both sides of a sheet and partial coating which transfers liquid on a specific portion of one side or both sides of the sheet, the apparatus comprising:

a first transfer cylinder which transfers the liquid to the entire surface of one side of the sheet; and a transport cylinder which opposes said first transfer cylinder, holds and conveys the sheet, and transfers the liquid to the entire surface of the other side of the sheet, wherein said first transfer cylinder and said transport cylinder transfer the liquid such that an edge, on a downstream side in a sheet convey direction, of the entire surface of one side of the sheet where the liquid is to be transferred, is located upstream of an edge, on a downstream side in the sheet convey direction, of the entire surface of the other side of the sheet where the liquid is to be transferred, the apparatus further comprising:

a liquid supply cylinder which comes into contact with said first transfer cylinder to supply the liquid thereto; and a first phase adjusting unit which is provided in said liquid supply cylinder and adjusts a phase of said liquid supply cylinder with respect to said first transfer cylinder by rotating said liquid supply cylinder such that a first notch of said liquid supply cylinder and a starting end of a first effective impression area which is continuous to the first notch are respectively positioned upstream in a rotational direction of said liquid supply cylinder from a second notch of said first transfer cylinder and a starting end of a second effective impression area which is continuous to the second notch, wherein said liquid supply cylinder is configured to supply the liquid to said first transfer cylinder while maintaining a phase adjusted by said first phase adjusting unit, further comprising:

a liquid supply cylinder which comes into contact with said first transfer cylinder to supply the liquid thereto, a second transfer cylinder which comes into contact with said transport cylinder to transfer the liquid thereto, wherein said liquid supply cylinder comprises a blanket for said liquid supply cylinder to be mounted on a circumferential surface of said liquid supply cylinder, and a sheet member for said liquid supply cylinder to be sandwiched between said blanket for said liquid supply cylinder and said circumferential surface of said liquid supply cylinder, said second transfer cylinder comprises a blanket for said second transfer cylinder to be mounted on a circumferential surface of said second transfer cylinder and a sheet member for said second transfer cylinder to be sandwiched between said blanket for said second transfer cylinder and said circumferential surface of said second transfer cylinder, and a length of said sheet member for said liquid supply cylinder in an axial direction of said liquid supply cylinder is smaller than that of said sheet member for said second transfer cylinder in an axial direction of said second transfer cylinder, wherein said first transfer cylinder and said transport cylinder transfer the liquid such that an edge of the one side of the sheet, in a direction perpendicular to the sheet convey direction, where the liquid is to be transferred is located to be inside an edge of the other side of the sheet, in the direction perpendicular to the sheet convey direction, where the liquid is to be transferred.

* * * * *